US009417604B2

(12) United States Patent
Matsumaru et al.

(10) Patent No.: US 9,417,604 B2
(45) Date of Patent: Aug. 16, 2016

(54) IMAGE FORMING APPARATUS

(71) Applicant: CANON KABUSHIKI KAISHA, Tokyo (JP)

(72) Inventors: Naoki Matsumaru, Suntou-gun (JP); Noriyuki Komatsu, Numazu-shi (JP); Tetsuya Numata, Suntou-gun (JP); Osamu Anan, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/718,451

(22) Filed: May 21, 2015

(65) Prior Publication Data

US 2015/0346682 A1 Dec. 3, 2015

(30) Foreign Application Priority Data

May 29, 2014 (JP) ..... 2014-110961

(51) Int. Cl.
*G03G 21/18* (2006.01)
*G03G 21/16* (2006.01)

(52) U.S. Cl.
CPC ..... *G03G 21/1842* (2013.01); *G03G 21/1623* (2013.01); *G03G 21/1825* (2013.01); *G03G 21/1853* (2013.01); *G03G 2215/0132* (2013.01); *G03G 2221/1684* (2013.01)

(58) Field of Classification Search
CPC ..... G03G 21/1846; G03G 21/1853; G03G 2215/0673; G03G 2221/1884
See application file for complete search history.

(56) References Cited

U.S. PATENT DOCUMENTS

| | | | | |
|---|---|---|---|---|
| 6,963,706 | B2 | 11/2005 | Morioka et al. | |
| 7,203,442 | B2 | 4/2007 | Matsubara et al. | |
| 7,826,766 | B2 | 11/2010 | Okabe | |
| 8,238,784 | B2 | 8/2012 | Kusudo et al. | |
| 8,472,838 | B2 | 6/2013 | Numata et al. | |
| 8,571,445 | B2 | 10/2013 | Komatsu et al. | |
| 8,942,592 | B2 | 1/2015 | Uratani et al. | |
| 2007/0160380 | A1 * | 7/2007 | Imaizumi | G03G 21/1871 399/90 |
| 2014/0270845 | A1 | 9/2014 | Kawakami et al. | |
| 2014/0356014 | A1 * | 12/2014 | Sato | G03G 21/1846 399/90 |
| 2015/0010320 | A1 | 1/2015 | Komatsu et al. | |

FOREIGN PATENT DOCUMENTS

JP 2008-185830 A 8/2008

* cited by examiner

*Primary Examiner* — Gregory H Curran
(74) *Attorney, Agent, or Firm* — Fitzpatrick, Cella, Harper & Scinto

(57) ABSTRACT

An image forming apparatus in which a process cartridge is removably mountable to a main body of the image forming apparatus, including: a containing member configured to contain the process cartridge, movable between an outside position outside the main body and an inside position inside the main body, and provided with a guided portion to be guided from an outside; and a guiding portion provided in the main body and configured to guide the guided portion, wherein the guiding portion includes: a first guiding part configured to guide the guided portion when the containing member is moved from the outside position to the inside position by being inserted into the main body; and a second guiding part having a shape to return the guided portion toward the inside position when the containing member is further moved downstream of the inside position in an inserting direction of the containing member.

12 Claims, 16 Drawing Sheets

IMAGE FORMING APPARATUS

BACKGROUND OF THE INVENTION

1. Field of the Invention

The present invention relates to an image forming apparatus configured to form images on recording media by using an electrophotographic image forming process. Examples of the image forming apparatus include an electrophotographic copying machine, an electrophotographic printer (such as laser beam printer and LED printer), a facsimile machine, and a word processor.

2. Description of the Related Art

Hitherto, in image forming apparatus using an electrophotographic image forming process, there has been known a process cartridge system in which drums and developing units each housing a developing roller to affect the corresponding drums and each containing developer (toner) to be used for image formation are integrated with each other. Further, there has also been known a developing cartridge system in which the cartridge has only the developing units independently of the drums. Those cartridge systems allow users themselves to perform maintenance of the image forming apparatus without service engineers. Thus, those cartridge systems have been widely used in image forming apparatus.

Further, there has also been known a configuration in which a cartridge tray movable while supporting cartridges is arranged, and this cartridge tray is pulled out from an inside of a main body of the image forming apparatus so that an operation of replacing various cartridges can be performed. This configuration allows users to easily replace the process cartridges or the developing cartridges.

There have been proposed various configurations for suppressing scattering of toner or damage to components in the image forming apparatus including the cartridge tray, which may be caused by mounting the cartridge tray with a significant force (hereinafter referred to as "forceful mounting").

For example, there has been proposed a configuration in which a frictional force imparting member is fixed in a main body of the image forming apparatus and brought into contact with the moving cartridge tray so that the force of the cartridge tray is reduced (FIG. 9 in Japanese Patent Application Laid-Open No. 2008-185830).

However, in the case where the frictional force imparting member is provided in the main body of the image forming apparatus, the cartridge tray cannot be sufficiently decelerated. As a result, the scattering of toner and the damage to components may not be sufficiently suppressed.

In view of the above-mentioned circumstances, there have been demands to sufficiently suppress the scattering of toner and the damage to components, which may be caused by forceful mounting of a cartridge tray, with a simple configuration.

SUMMARY OF THE INVENTION

According to a representative embodiment of the present invention, there is disclosed an image forming apparatus in which a process cartridge is removably mountable to a main body of the image forming apparatus, the image forming apparatus comprising: a containing member configured to contain the process cartridge and movable between an outside position outside the main body and an inside position inside the main body in a state of containing the process cartridge, the containing member being provided with a guided portion to be guided from an outside of the containing member; and a guiding portion provided in the main body and configured to guide a movement of the guided portion, wherein the guiding portion includes: a first guiding part configured to guide the guided portion when the containing member is moved from the outside position to the inside position by being inserted into the main body; and a second guiding part having a shape to return the guided portion toward the inside position when the containing member is further moved to a downstream side of the inside position in an inserting direction of the containing member.

Further features of the present invention will become apparent from the following description of exemplary embodiments with reference to the attached drawings.

DESCRIPTION OF THE EMBODIMENTS

Now, embodiments of the present invention will be described in detail with reference to the drawings.

First Embodiment

<Overall Configuration of Image Forming Apparatus>

An overall configuration of an image forming apparatus according to an embodiment of the present invention will be described.

Figure 1:
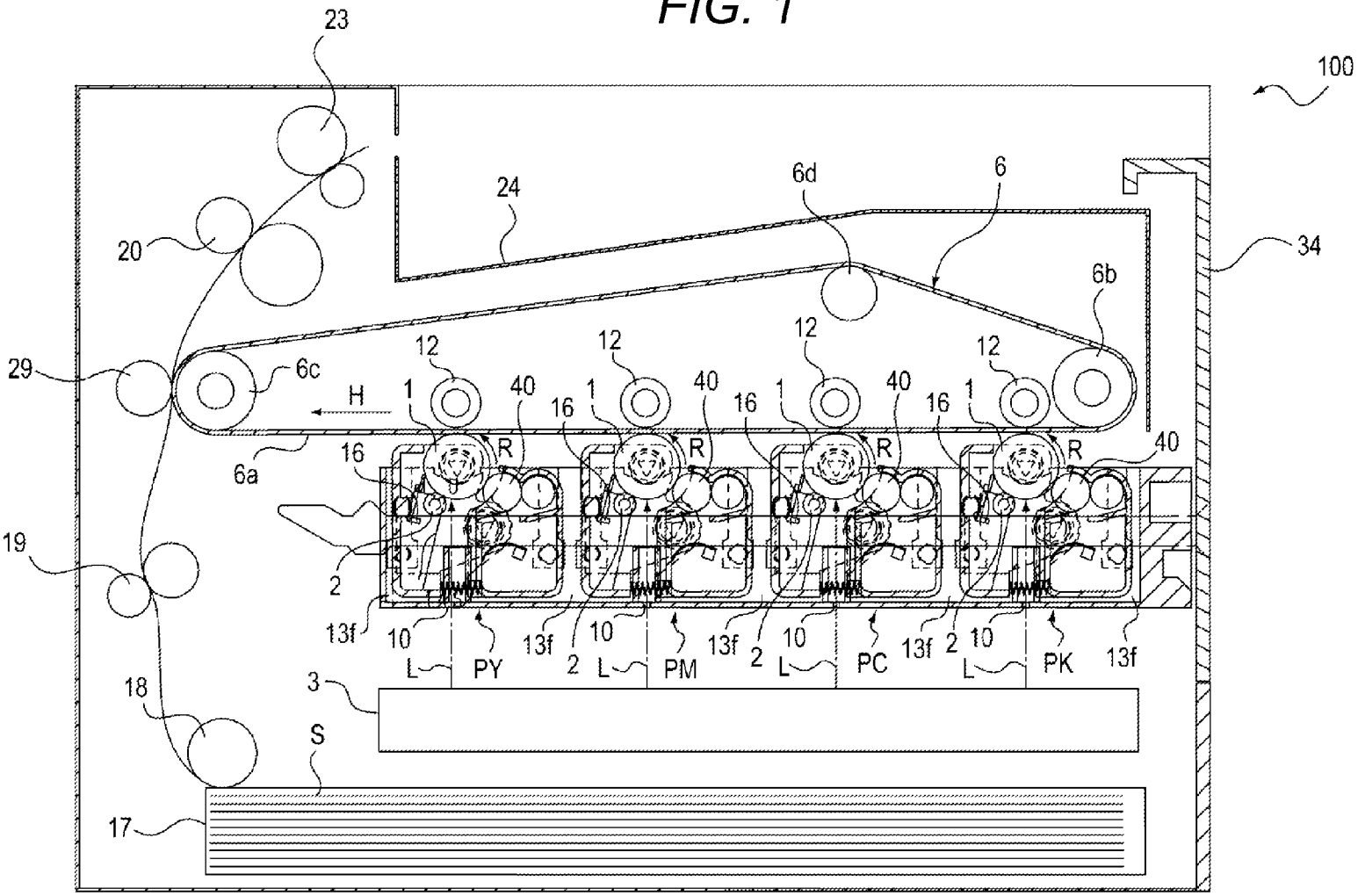
FIG. 1 is an overall schematic sectional view of an image forming apparatus according to an embodiment of the present invention.

FIG. 1 is an overall schematic sectional view of the image forming apparatus according to the embodiment of the present invention. The image forming apparatus illustrated in FIG. 1 includes process cartridges PY, PM, PC, and PK each including a drum 1, and a main body 100 constructed such that those process cartridges PY, PM, PC, and PK can be mounted thereinto and removed therefrom.

In the following description, a rotation axis direction of the drum 1 is referred to as a longitudinal direction. Further, a side on which an opening/closing door 34 is arranged is referred to as a front side (front surface side). A rear side refers to a side opposite thereto, and front and rear directions refer to a direction from the front side toward the rear side of the main body 100, and a direction opposite thereto. Further, the left and the right correspond to the left and the right as viewed from the front side of the main body 100. Further, the process cartridges PY, PM, PC, and PK are collectively described as process cartridges P.

As illustrated in FIG. 1, the main body 100 includes a cartridge tray 13 (containing member). This cartridge tray 13 includes four cartridge containing portions 13*f* configured to respectively contain the four process cartridges PY, PM, PC, and PK. From the rear side toward the front side of the main body 100, the four process cartridges PY, PM, PC, and PK are arrayed in a horizontal direction. The process cartridges P are the same electrophotographic process mechanisms that are different from each other only in color of contained developer. The four drums 1 that are arrayed in the horizontal direction are each rotated in a direction of the arrow R in FIG. 1 by drive units (not shown) in the main body 100.

In the main body 100, a scanner unit 3 is provided on a lower side in a gravity direction of the process cartridges P. This scanner unit 3 outputs laser beams L modulated in accordance with image information. Then, the laser beams L are radiated onto drum surfaces of the drums 1 of the process cartridges P through exposure window portions 10 that are formed through the process cartridges P. An intermediate transfer belt unit 6 as a transfer member is arranged above the process cartridges P. The intermediate transfer belt unit 6 includes a driving roller 6*b*, a secondary transfer opposing roller 6*c*, a tension roller 6*d*, and a flexible dielectric endless belt 6*a* that is stretched around those rollers.

The endless belt 6*a* extends substantially in the same direction as a moving direction of the cartridge tray 13, and also in the longitudinal direction of the drum 1.

(Overall Operation of Image Forming Apparatus)

Next, an operation of forming a full-color image will be described.

The drums 1 of the process cartridges P are each driven to rotate at a predetermined speed. The endless belt 6*a* is driven to rotate in a direction of the arrow H in FIG. 1 at a speed in accordance with the speed of the drums 1. In synchronization with the driving, in each of the cartridges P, a charging roller 2 as a charging unit uniformly charges the surface of the drum 1 with a predetermined polarity and electric potential at a predetermined control timing. The scanner unit 3 performs scanning exposure on the surfaces of the drums 1 with the laser beams L that are modulated in accordance with image signals of respective colors. With this, electrostatic latent images of the image signals of corresponding colors are formed on the surfaces of the drums 1. The electrostatic latent images thus formed are developed by developing rollers 40 as developing units.

Then, those developer images are primarily transferred onto the endless belt 6*a* at primary-transfer nip portions as contact portions between the drums 1 and the endless belt 6*a*. Primary transfer rollers 12 are each held in press-contact with the drum 1 through intermediation of the endless belt 6*a* to form the primary-transfer nip portion.

In this way, on the endless belt 6*a*, a four-full-color unfixed developer image is formed by combining a color Y, a color M, a color C, and a color K. In each of the process cartridges P, untransferred residual toner remaining on the drum surface of the drum 1 after the primary transfer of the developer image onto the endless belt 6*a* is removed by a cleaning blade 16 as a cleaning unit, and sent into a waste toner collecting portion.

Meanwhile, a feed roller 18 is driven at predetermined control timings. With this, sheet-like recording media S (transferred materials) received and stacked in a sheet feeding cassette 17 are fed. Then, at a predetermined timing, the recording medium S is introduced by a registration roller pair 19 into a secondary-transfer nip portion as a contact portion between the endless belt 6*a* and the secondary transfer roller 29.

A secondary transfer bias having a polarity reverse to the charging polarity of the developer and having a predetermined electric potential is applied to the secondary transfer roller 29 at a predetermined timing. With this, the four-color-superimposed developer image on the endless belt 6*a* is secondarily transferred onto a surface of the recording medium S while the recording medium S is nipped and conveyed through the secondary-transfer nip portion. The recording medium S, which passes through the secondary-transfer nip portion, is separated from the surface of the endless belt 6*a* and is introduced into a fixing device 20. Then, the recording medium S is heated and pressurized in a fixing nip portion. With this, the above-mentioned colors of the developer images are mixed with each other, and the developer images are fixed onto the recording medium S. Then, the recording medium S is fed out from the fixing device 20, and delivered as a full-color image by a delivery roller pair 23 onto a delivery tray 24.

(General Configuration of Cartridge Tray)

Next, the cartridge tray 13 movable between an inside position (storage position) on the inside of the main body 100 and an outside position (pullout position) on the outside of the main body 100 while supporting the process cartridges P will be described. Note that, the inside position refers to a position of the cartridge tray 13 that is stored in the main body 100, and the outside position refers to a position of the cartridge tray 13 that is pulled out so that the process cartridges P can be replaced.

Figure 2:
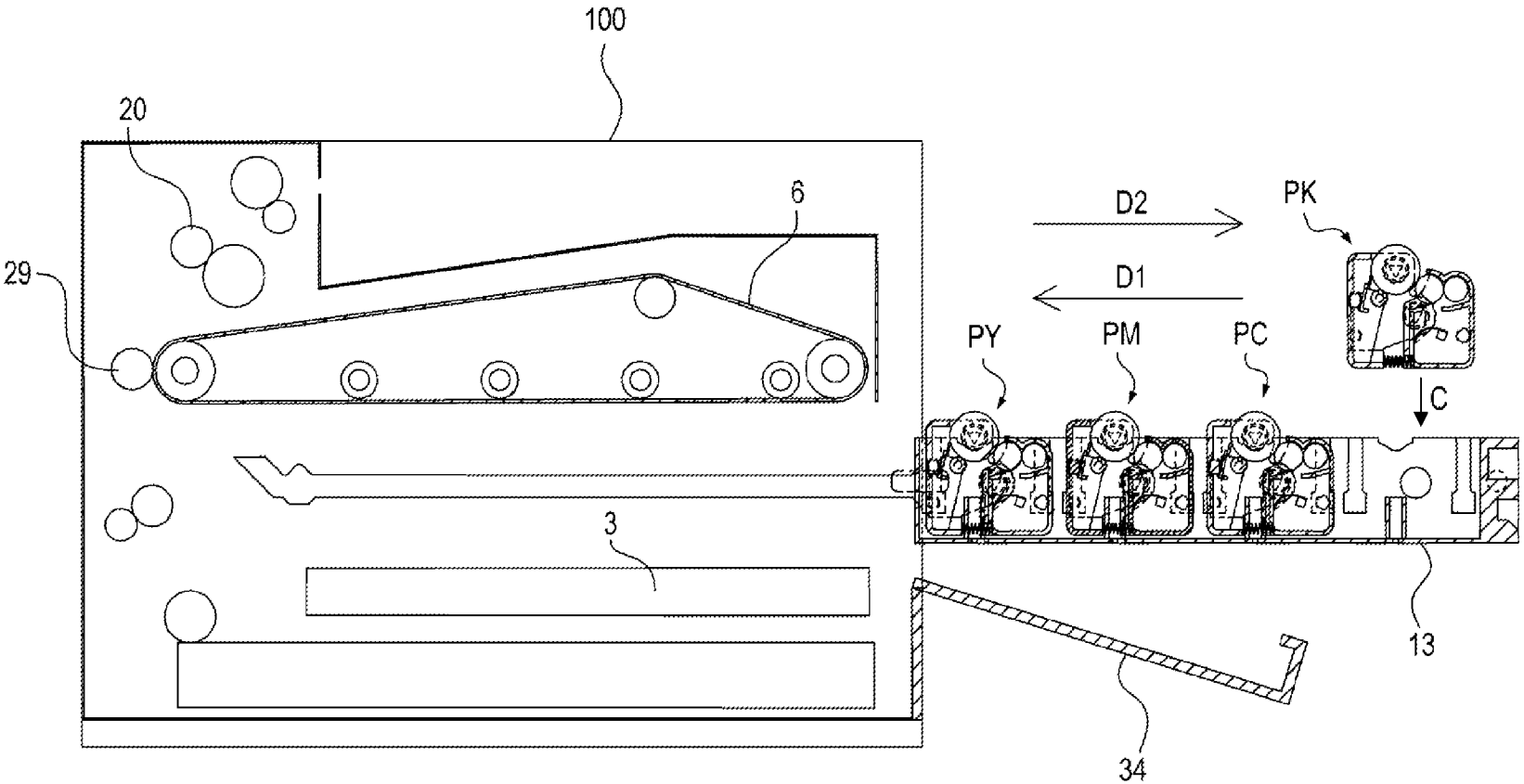
FIG. 2 is a sectional view of the image forming apparatus according to the embodiment of the present invention, for illustrating a state in which a cartridge tray is moved from an inside of a main body to an outside position.

FIG. 2 is a sectional view of a state in which the cartridge tray 13 is moved from the inside of the main body 100 to the outside position. As illustrated in FIG. 2, the cartridge tray 13 can be linearly moved with respect to (pushed into or pulled out from) the main body 100 substantially in the horizontal direction (directions of the arrows D1 and D2). With this, the cartridge tray 13 can be moved to the inside position in the inside of the main body 100 (position illustrated in FIG. 1), or to the outside position corresponding to the position of the cartridge tray 13 that is pulled out to the outside of the main body 100 (position illustrated in FIG. 2).

Further, in the state in which the cartridge tray 13 is located in the outside position, the process cartridges P are mounted into the cartridge tray 13 substantially in the gravity direction (direction of the arrow C in FIG. 2) by a user. The process cartridges P thus mounted are arranged so that longitudinal directions thereof are orthogonal to the moving direction of the cartridge tray 13. Note that, the four process cartridges PY, PM, PC, and PK are arrayed in the moving direction of the cartridge tray 13.

The process cartridges P are moved into the main body 100 together with the cartridge tray 13 in the state of being mounted into the cartridge tray 13. Then, when an insertion opening for the cartridge tray 13 is closed by the opening/closing door 34 in the state in which the cartridge tray 13 is moved into the main body 100, all the process cartridges P are positioned to predetermined positions in the main body 100.

With the configuration described above, the four process cartridges P can be collectively mounted into the main body 100, and the four process cartridges P can be collectively pulled out to the outside of the main body 100. Thus, operability at the time of replacement of the process cartridges P is more excellent than that in a case where a configuration of independently mounting the process cartridges P into the main body 100 is employed.

(Specific Configuration of Cartridge Tray)

Figure 3:
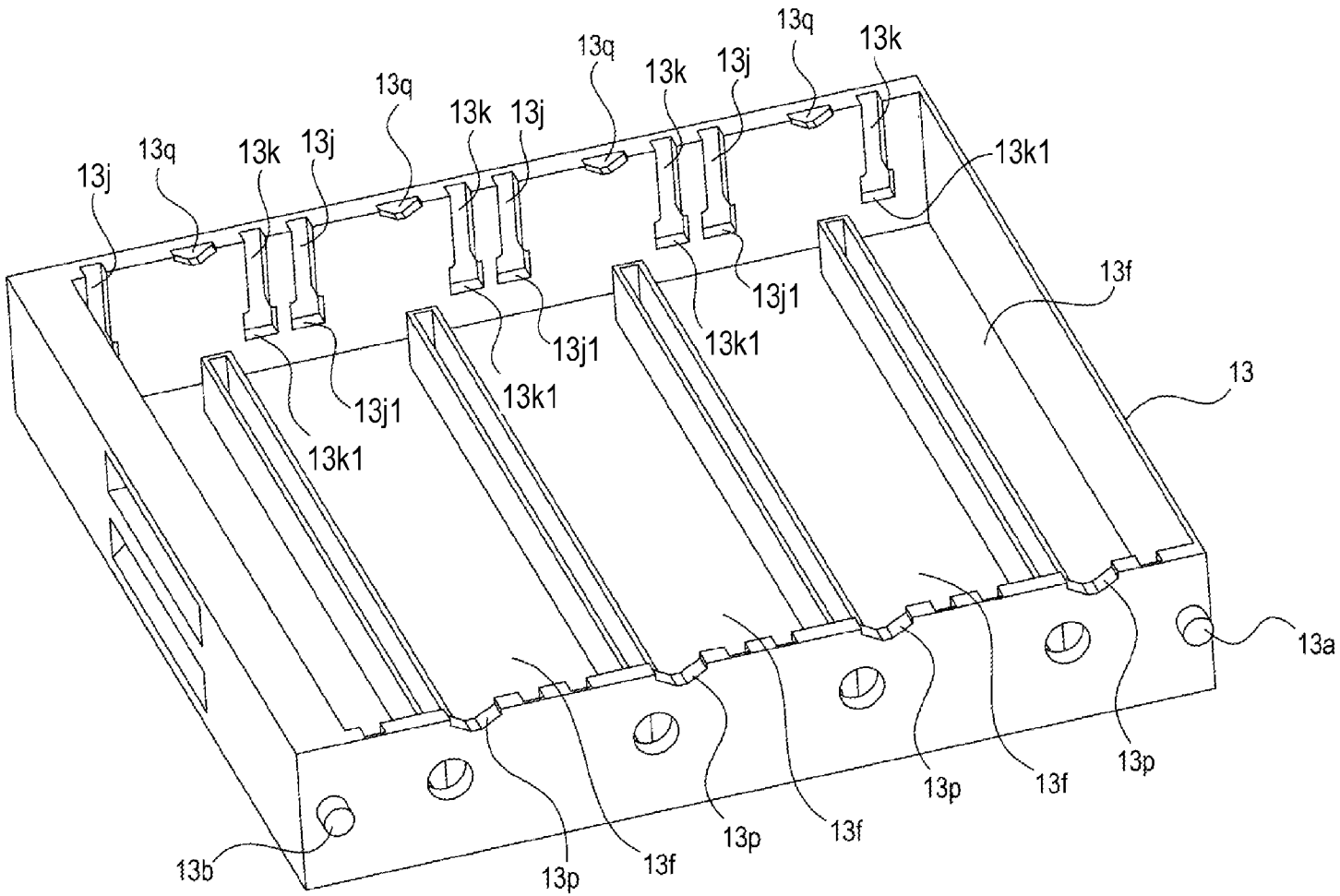
FIG. 3 is a perspective view of the cartridge tray of the image forming apparatus according to the embodiment of the present invention.
Figure 4:
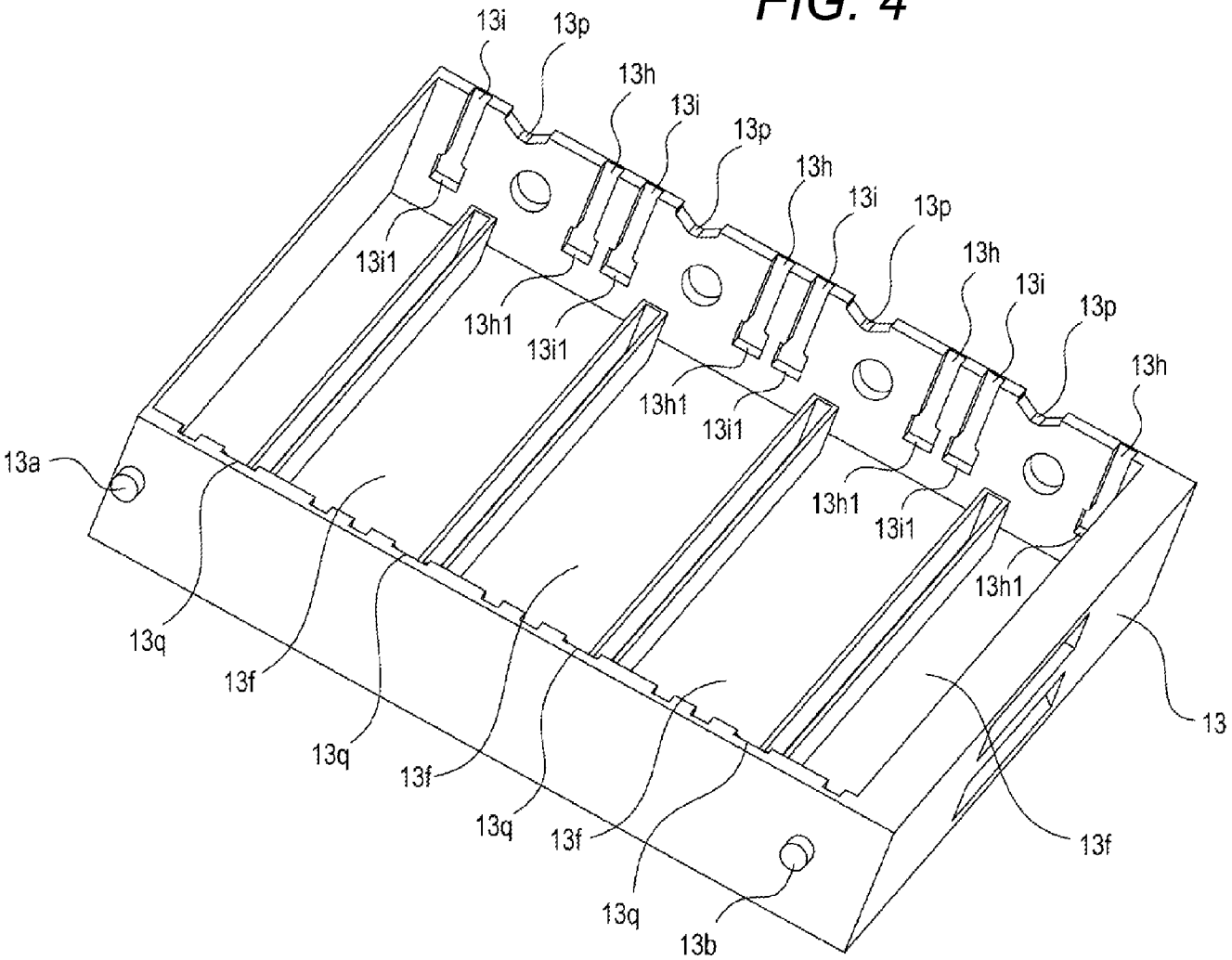
FIG. 4 is a perspective view of the cartridge tray of the image forming apparatus according to the embodiment of the present invention as viewed from a side opposite to that in FIG. 3.

Next, a configuration of the cartridge tray 13 will be described in detail. FIG. 3 is a perspective view of the cartridge tray 13 of the image forming apparatus according to the embodiment. FIG. 4 is a perspective view of the cartridge tray 13 as viewed from a side opposite to that in FIG. 3.

As illustrated in FIGS. 3 and 4, at four corners of the cartridge tray 13, a pair of guided portions 13*a* and a pair of guided portions 13*b* to be guided along guiding portions of the main body 100 described below are formed. Those pairs of guided portions 13*a* and 13*b* are each formed into a columnar shape projecting outward from side surfaces of the cartridge tray 13.

Further, in the cartridge tray 13, the cartridge containing portions 13*f* configured to allow the process cartridges P to be mounted thereinto are formed in an array. At both end portions in the longitudinal direction of each of the cartridge containing portions 13*f*, guiding portions 13*h*, 13*i*, 13*j*, and 13*k* configured to allow the process cartridges P to be mounted into the cartridge tray 13 are formed. The guiding portions 13*h*, 13*i*, 13*j*, and 13*k* each extend in a vertical direction. In addition, positioning portions 13*p* and 13*q* configured to position the process cartridges P with respect to the cartridge tray 13 are formed respectively between the guiding portions 13*h* and 13*i* and between the guiding portions 13*j* and 13*k*. The positioning portions 13*p* and 13*q* are each formed into a V-shape.

(Configuration of Process Cartridge)

Next, the process cartridge P to be mounted into the cartridge tray 13 will be described.

Figure 5:
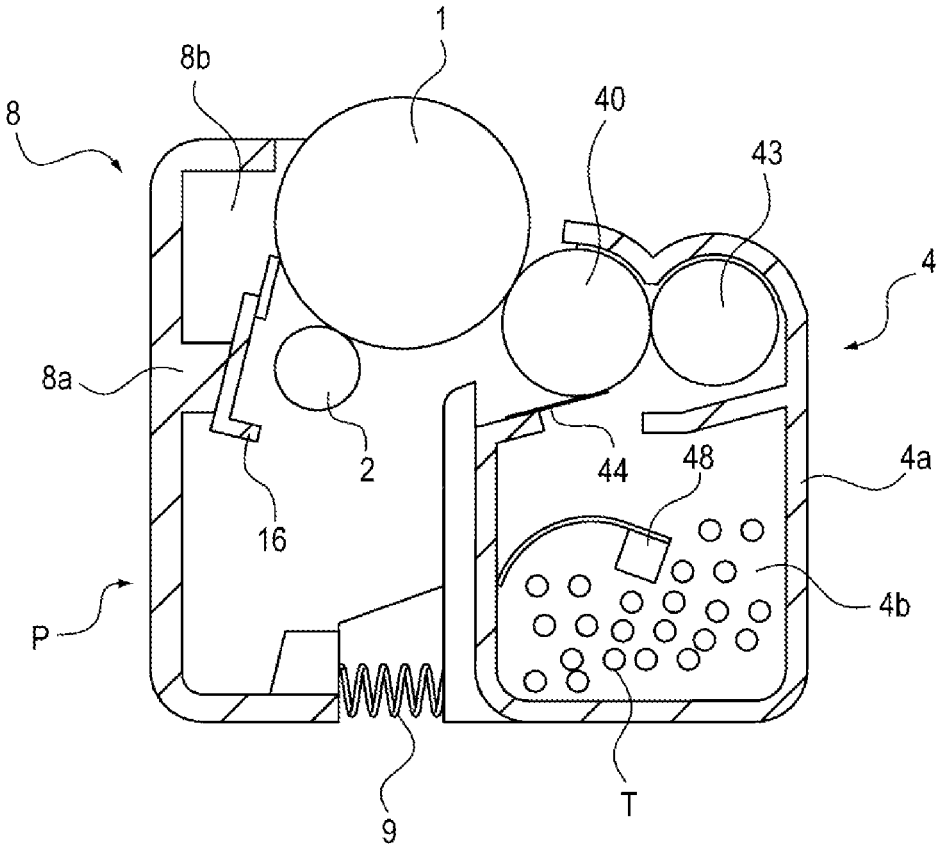
FIG. 5 is a schematic sectional view of a process cartridge according to the embodiment of the present invention.
Figure 6:
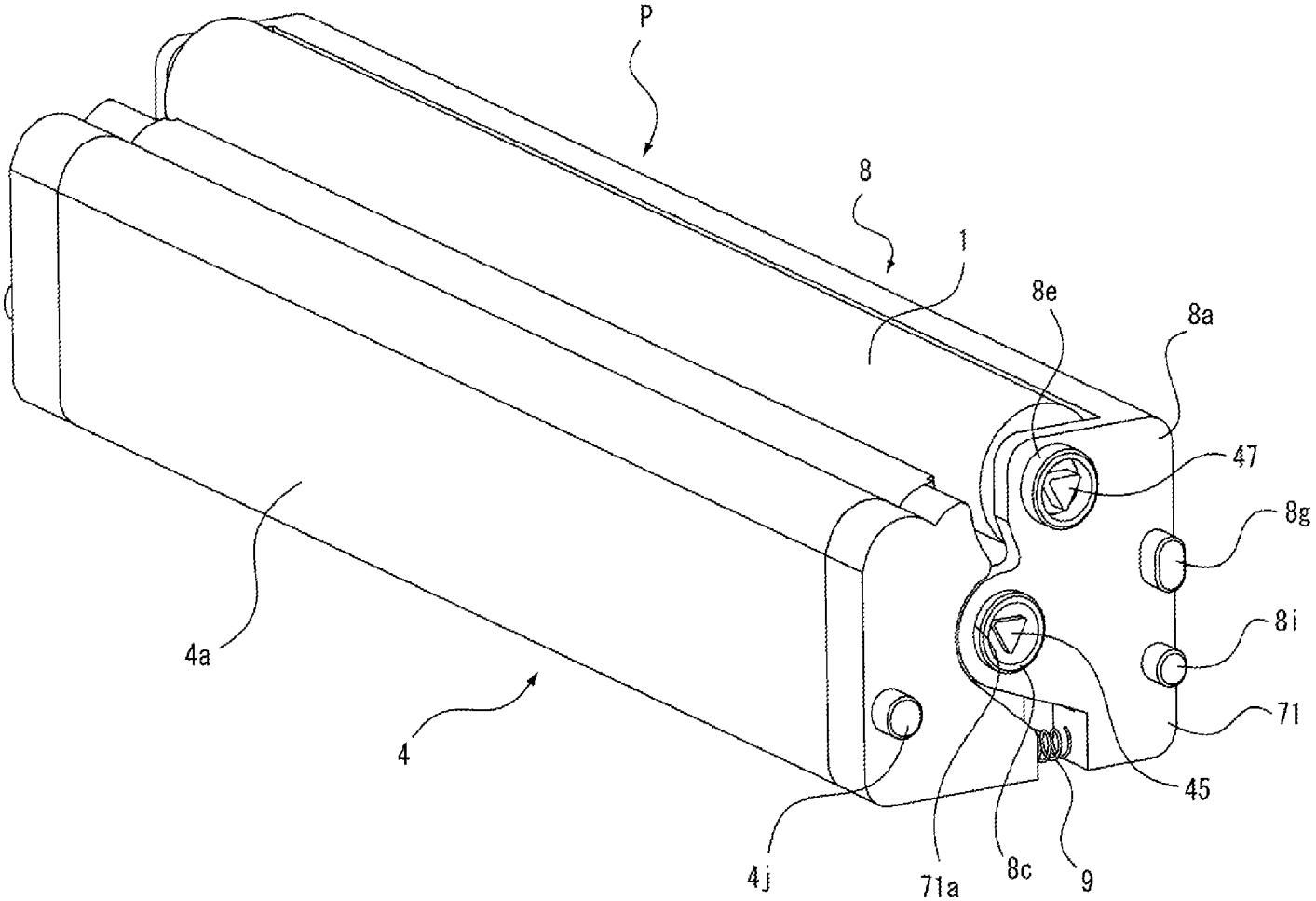
FIG. 6 is a perspective view of the process cartridge according to the embodiment of the present invention.
Figure 7:
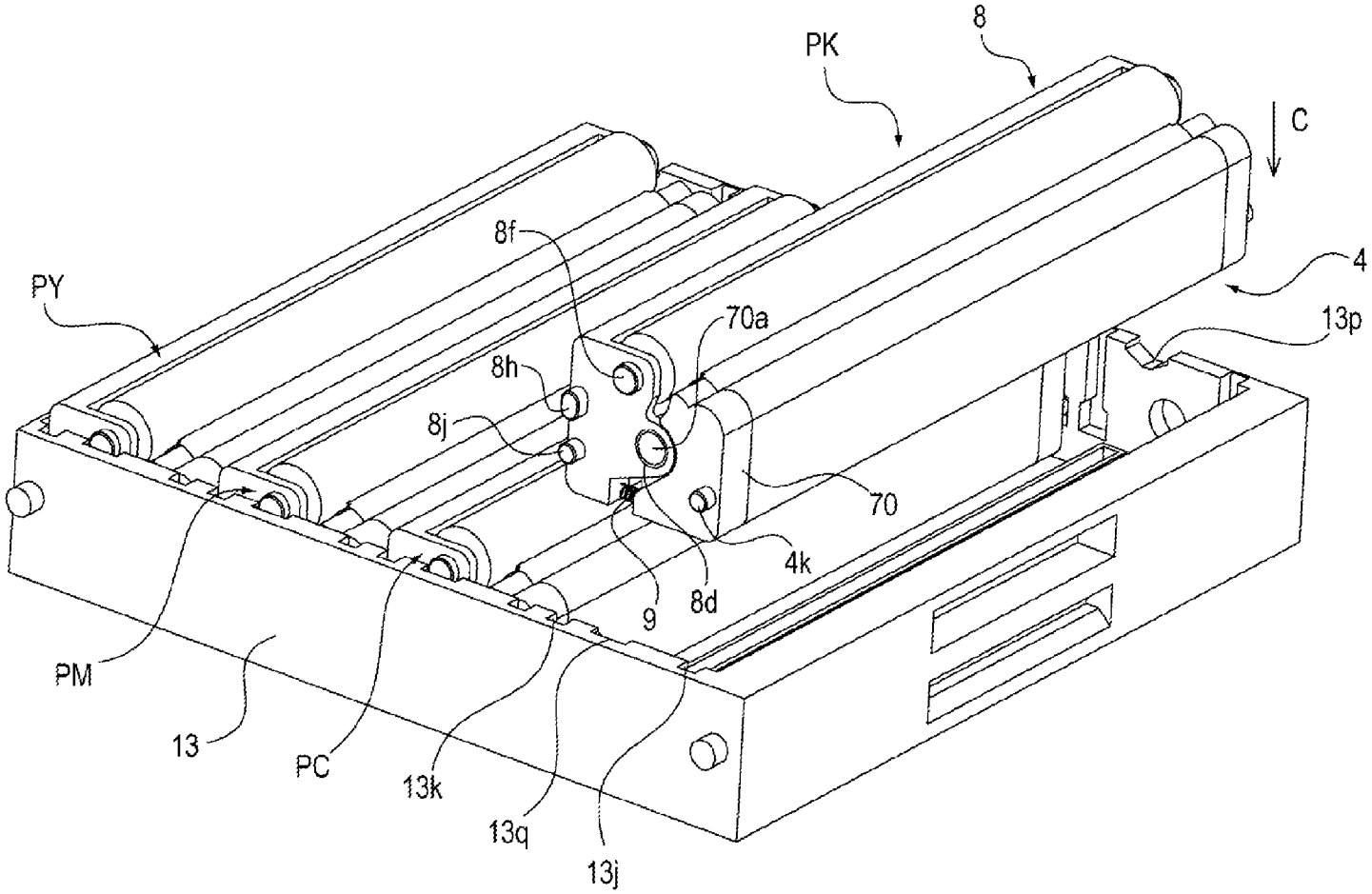
FIG. 7 is a perspective view illustrating how the process cartridge according to the embodiment of the present invention is mounted into the cartridge tray.

FIG. 5 is a schematic sectional view of the process cartridge P according to the embodiment. FIG. 6 is a perspective view of the process cartridge P according to the embodiment. FIG. 7 is a perspective view illustrating how the process cartridge P according to the embodiment is mounted into the cartridge tray 13.

As illustrated in FIG. 5, the process cartridge P includes a photosensitive unit 8 and a developing unit 4. Further, the photosensitive unit 8 includes the drum 1, a photosensitive frame 8*a* configured to support the drum 1, the charging roller 2, the cleaning blade 16, and a waste toner collecting portion 8*b* configured to collect the developer (hereinafter referred to as "toner") removed by the cleaning blade 16. Further, the developing unit 4 includes the developing roller 40, a developing frame 4*a* configured to support the developing roller 40, a toner supply roller 43, and a developing blade 44. In addition, the developing unit 4 also includes a toner containing portion 4*b* configured to contain toner T to be used for image formation, and a conveying member 48 configured to supply the toner T in the toner containing portion 4*b*.

The toner T in the toner containing portion 4*b* is supplied to the toner supply roller 43 by the conveying member 48. Then, the toner supply roller 43 and the developing blade 44 that is held in press-contact with an outer periphery of the developing roller 40 causes the toner T to be applied to the outer periphery of the developing roller 40 and to be electrically charged. Then, a developing bias is applied from the main body 100 to the developing roller 40 so that the toner T adheres to the latent image formed on the drum 1 to form a toner image. After the toner image formed on the drum 1 is transferred onto the endless belt 6*a*, the toner T remaining on the surface of the drum 1 is removed by the cleaning blade 16, and collected into the waste toner collecting portion 8*b*.

Note that, in a case where the toner T in the toner containing portion 4*b* is consumed, the user only has to replace the process cartridge P to perform printing again.

As illustrated in FIG. 6, at ends of the photosensitive unit 8 and the developing unit 4 on one side, coupling members 47 and 45 configured to receive a driving force from the main body 100 are supported to be turnable. The coupling member 47 is formed at one end of the drum 1 to receive the driving force from the main body 100, to thereby rotate the drum 1. Further, the driving force from the main body 100, which is received by the coupling member 45, is transmitted to the developing roller 40, the toner supply roller 43, and the conveying member 48 through intermediation of an intermediate gear (not shown) to rotate those components (refer to FIG. 5).

An outer periphery of the coupling member 45 is covered with a cylindrical rib. With this, an engagement portion 71*a* is formed on a side cover 71 fixed to an outside of the developing frame 4*a*. The coupling member 45 is configured to be turnable about the engagement portion 71*a*. Further, as illustrated in FIG. 7, an engagement portion 70*a* is formed also on a side opposite to the engagement portion 71*a*. This engagement portion 70*a* is formed on a side cover 70.

Further, hole portions 8*c* and 8*d* configured to support the engagement portions 71*a* and 70*a* are formed through the photosensitive frame 8*a*. The hole portions 8*c* and 8*d* formed through the photosensitive frame 8*a* are engaged with the engagement portions 71*a* and 70*a* provided on the developing unit 4. With this, the photosensitive unit 8 and the developing unit 4 are coupled to each other.

Specifically, the engagement portions 71*a* and 70*a* are configured to be turnable respectively about the hole portions 8*c* and 8*d*, and hence the developing unit 4 can be moved with respect to the photosensitive unit 8. In other words, the developing roller 40 is configured to be movable with respect to the drum 1.

As illustrated in FIGS. 5 to 7, a spring 9 as a biasing member is interposed between the photosensitive unit 8 and the developing unit 4. This spring 9 generates a predetermined pressure for pressing the developing roller 40 against the drum 1.

As illustrated in FIG. 6, an outer periphery of the coupling member 47 is covered with a cylindrical rib. With this, a positioned portion 8*e* is formed. Further, as illustrated in FIG. 7, on a side opposite to the positioned portion 8*e*, another positioned portion 8*f* is formed of a cylindrical projection.

Further, as illustrated in FIG. 6, a rotation regulated portion 8*g* is arranged below the positioned portion 8*e*. As illustrated in FIG. 7, a rotation regulated portion 8*h* is arranged below the positioned portion 8*f*. The rotation regulated portions 8*g* and 8*h* are each formed into a shape of a substantially rectangular column extending in the same direction as a mounting direction of the process cartridge P into the cartridge tray 13, which is indicated by the arrow C.

The process cartridge P to be inserted into the cartridge tray 13 is positioned by those positioned portions 8*e* and 8*f* and rotation regulated portions 8*g* and 8*h*.

Further, columnar regulated portions 8*i*, 4*j*, 8*j*, and 4*k* are formed below the rotation regulated portions 8*g* and 8*h*. The regulated portions 8*i* and 8*j* and the regulated portions 4*j* and 4*k* are provided on the photosensitive unit 8 and the developing unit 4, respectively, in a manner of sandwiching the drum 1.

(Mounting of Process Cartridge)

Figure 8:
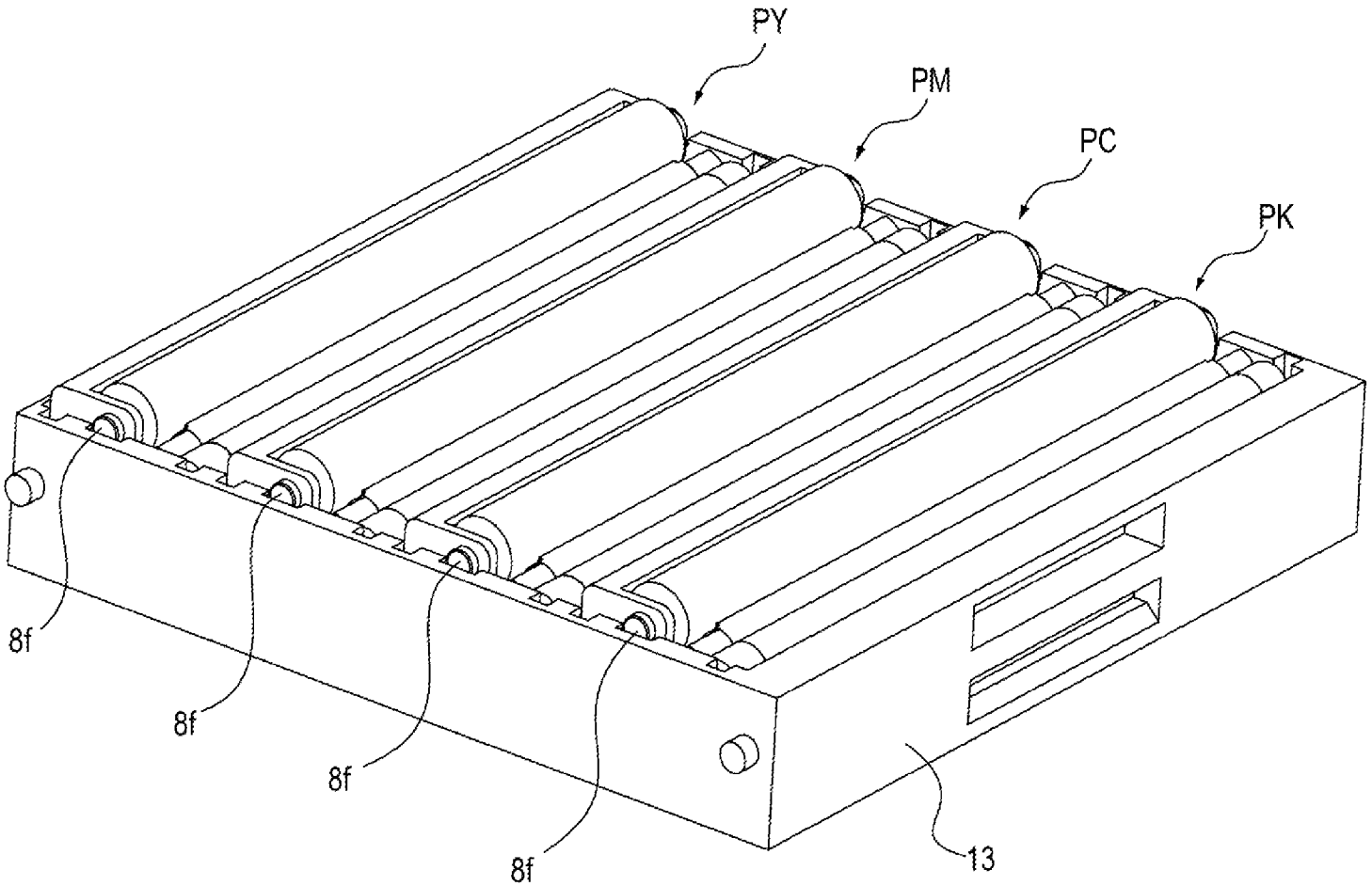
FIG. 8 is a view of the cartridge tray in a state in which all the process cartridges according to the embodiment of the present invention are mounted.

With reference to FIGS. 7 and 8, how the process cartridges P are mounted into the cartridge tray 13 will be described. FIG. 8 illustrates the cartridge trays 13 in a state in which all the process cartridges P are mounted.

The process cartridges PY, PM, PC, and PK are mounted respectively into the cartridge containing portions 13*f* formed at four positions in the cartridge tray 13 (refer to FIGS. 3 and 4). The user mounts the process cartridges P in the direction of the arrow C substantially corresponding to the gravity direction.

In order to mount the process cartridge P, the user first mounts the regulated portions 8*j*, 4*k*, 8*i*, and 4*j* provided on both end portions of the process cartridge P along the guiding portions 13*k*, 13*j*, 13*i*, and 13*h* of the cartridge tray 13. Next, the user mounts the rotation regulated portions 8*g* and 8*h* along the guiding portions 13*i* and 13*k* (refer to FIGS. 3 and 4). In this way, the process cartridge P is guided along the guiding portions 13*k*, 13*j*, 13*i*, and 13*h* and mounted into the cartridge tray 13.

When the process cartridges P are mounted into the cartridge tray 13, the positioned portions 8*e* and 8*f* are brought into contact with the positioning portions 13*p* and 13*q* formed in the cartridge tray 13. The positioning portions 13*p* and 13*q* are each formed into a V-shape, and hence, when the positioning portions 13*p* and 13*q* are brought into contact with the columnar positioned portions 8*e* and 8*f*, the process cartridge P can be positioned in the mounting direction of the process cartridge P. Further, the rotation regulated portions 8*h* and 8*g* are brought into contact with side surfaces of the guiding portions 13*k* and 13*i*. With this, a posture in a turning direction of the process cartridge P can be determined. The positioned portions 8*e* and 8*f* and the rotation regulated portions 8*h* and 8*g* allow the process cartridge P to be positioned in the cartridge tray 13.

Note that, the regulated portions 8*j*, 4*k*, 8*i*, and 4*j* reach retreat portions 13*k*1, 13*j*1, 13*i*1, and 13*h*1 (refer to FIGS. 3 and 4) that are formed on a depth side of the guiding portions 13*k*, 13*j*, 13*i*, and 13*h*, respectively. At those positions, the regulated portions 8*j*, 4*k*, 8*i*, and 4*j* are not held in contact with the cartridge tray 13, and hence do not hinder positioning of the process cartridge P with respect to the cartridge tray 13.

(Configuration for Mounting Toner Cartridge)

Next, how the cartridge tray 13 according to the embodiment is mounted into the main body 100 will be described.

Figure 9:
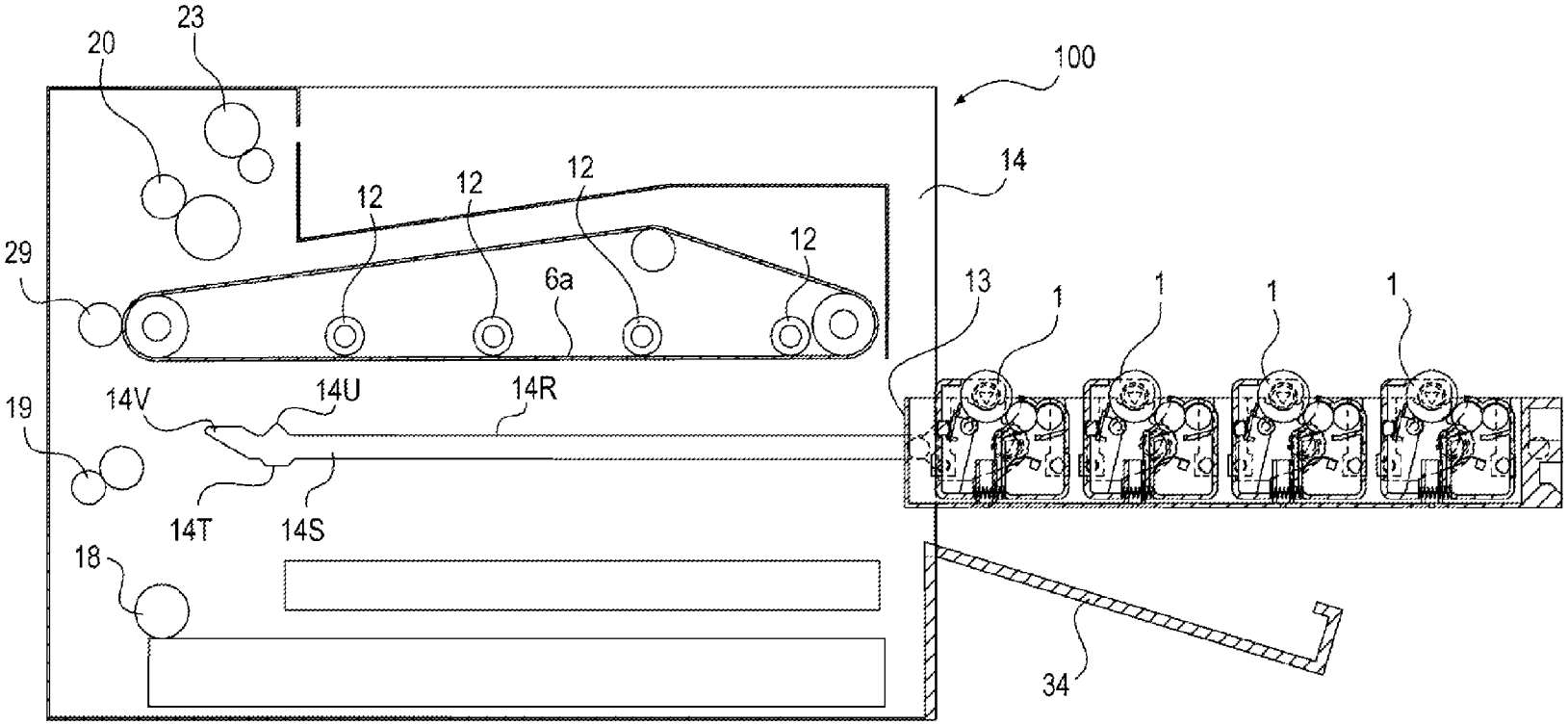
FIG. 9 is a schematic sectional view of the main body, for illustrating a shape of a guiding portion configured to guide the cartridge tray in the embodiment of the present invention.

FIG. 9 is a schematic sectional view of the main body 100, for illustrating a shape of a guiding portion configured to guide the cartridge tray 13. Note that, in the embodiment, configurations on the left and right are the same as each other, and hence only one side (right-hand side) will be described with reference to FIG. 9.

As illustrated in FIG. 9, on an inner wall surface of a frame 14 of the main body 100, there is fixed a guiding portion 14R configured to guide movement of the cartridge tray 13 by allowing the guided portions 13*a* and 13*b* of the cartridge tray 13 to pass through an inside thereof. The guiding portion 14R includes a first guiding part 14S configured to guide the movement of the cartridge tray 13, a positioning portion 14T (first positioning portion), another positioning portion 14U (second positioning portion), and a second guiding part 14V.

The first guiding part 14S is configured to guide the cartridge tray 13 from the position of the cartridge tray 13 that is pulled out to the outside of the main body 100 to the position of the cartridge tray 13 that is stored in the main body 100. In other words, the first guiding part 14S is formed to extend substantially in the horizontal direction from a vicinity of the insertion opening of the main body 100 (vicinity of the opening/closing door 34) to the depth side. This first guiding part 14S is provided by forming a recessed portion (substantially C-shape in cross section) in the inner wall surface of the frame 14.

The positioning portion 14T is a positioning portion configured to position the cartridge tray 13 in a transverse direction (insertion direction) of the cartridge tray 13. The positioning portion 14T is provided by forming a recessed portion (first recessed portion) on a lower side in the gravity direction of the first guiding part 14S. The positioning portion 14U is a positioning portion configured to position the cartridge tray 13 to an image formation position at the time of image formation. The positioning portion 14U is provided by forming a recessed portion (second recessed portion) having an inverted V-shape above the positioning portion 14T. The cartridge tray 13 is positioned when a part of the guided portion 13*a* enters the positioning portions 14T or 14U.

Further, the second guiding part 14V is formed in the guiding portion 14R to decelerate the cartridge tray 13 in a case where the cartridge tray 13 is forcefully mounted into the main body 100, and to return the cartridge tray 13 to a predetermined position. The configuration of this part will be described in detail below.

(Operation of Mounting Cartridge Tray)

Figure 10:
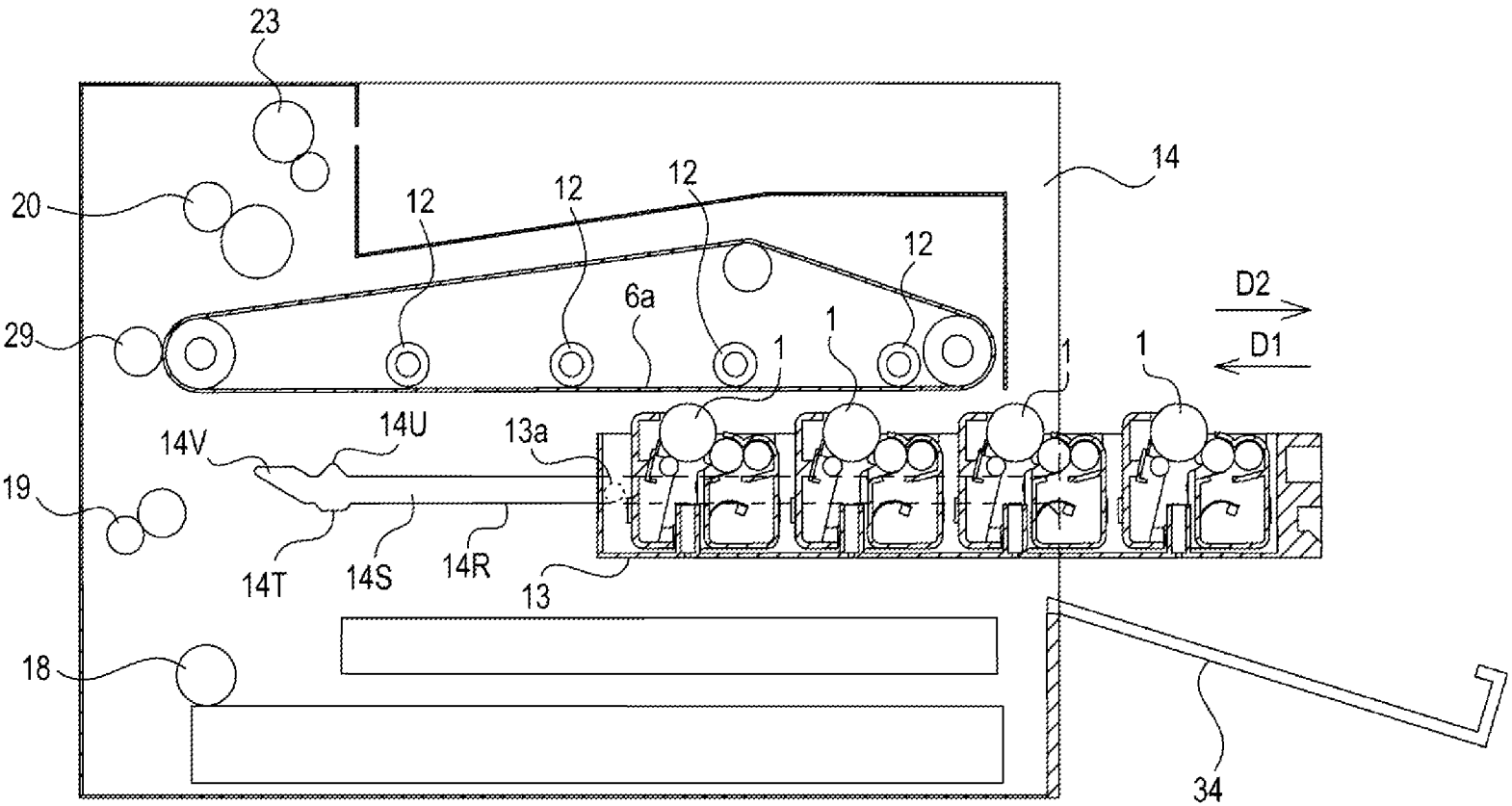
FIG. 10 is a view of a situation where the cartridge tray in the state illustrated in FIG. 9 is being pushed into the main body in the embodiment of the present invention.
Figure 11:
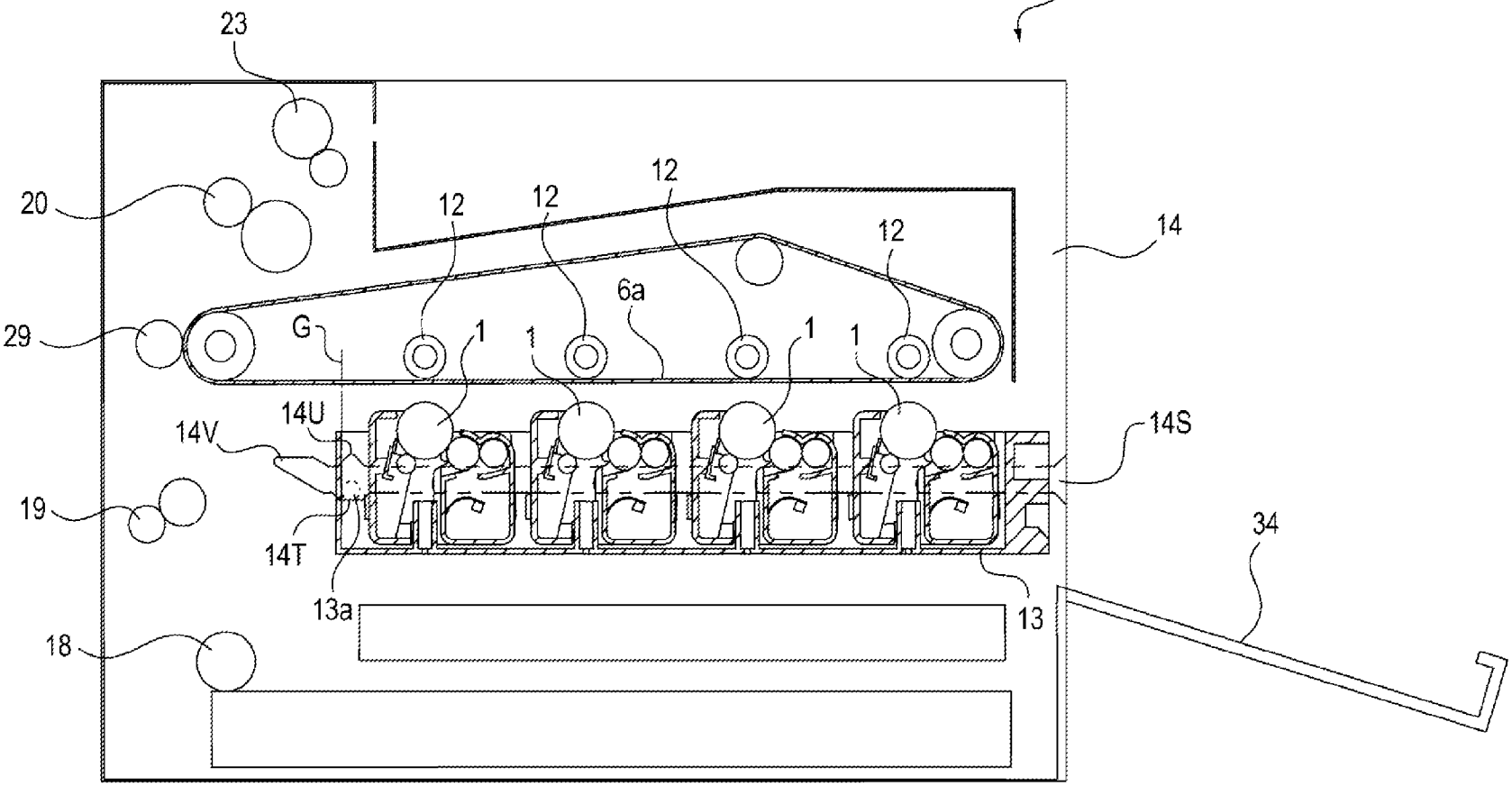
FIG. 11 is a view of a state in which a pair of guided portions is located in a positioning portion at the time of insertion of the cartridge tray in the embodiment of the present invention.
Figure 12:
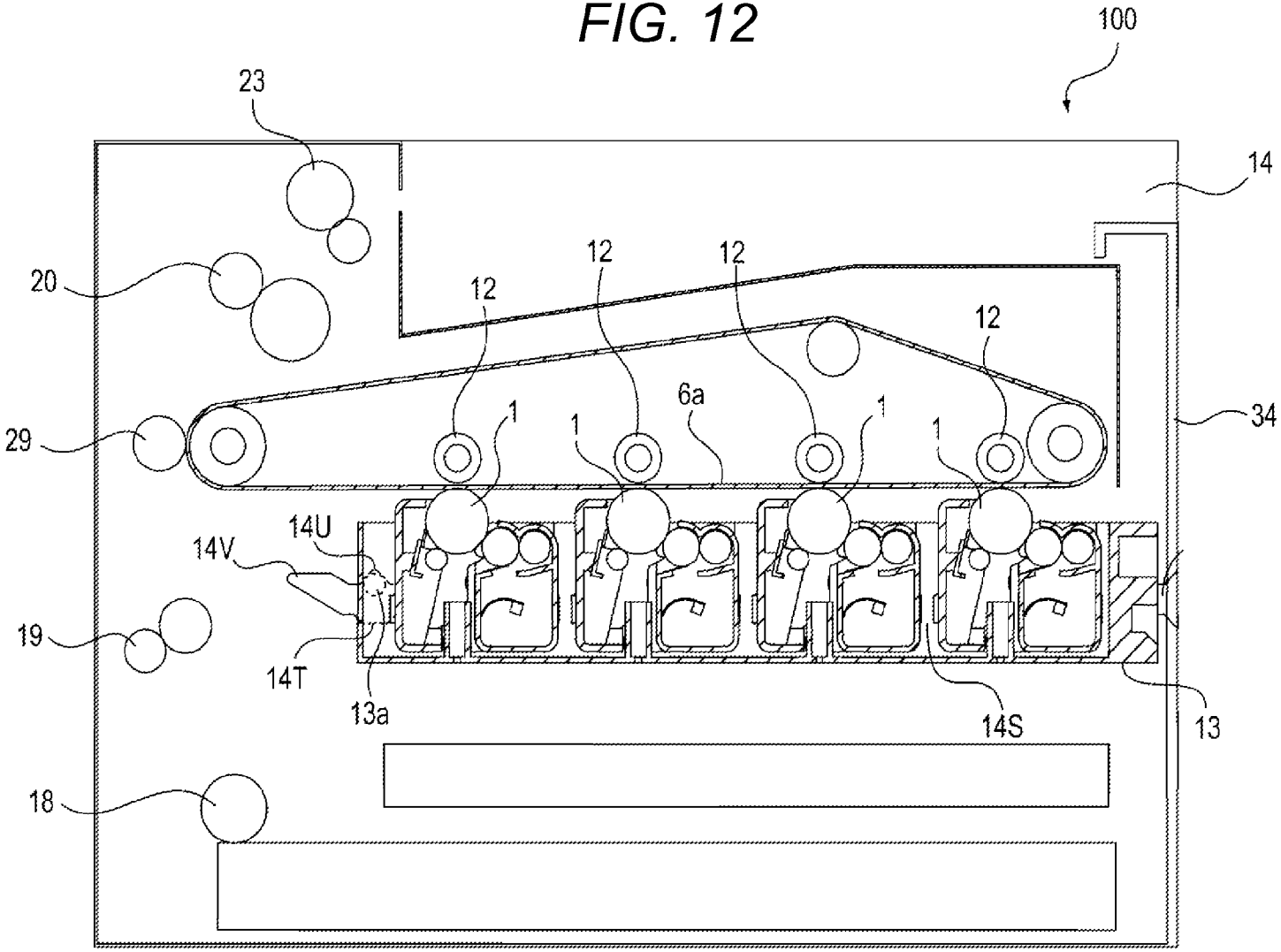
FIG. 12 is a view of a case where the cartridge tray is in an image formation mode in the embodiment of the present invention.

Next, an operation of mounting the cartridge tray 13 into the main body 100 will be described. FIG. 10 is a view of a situation where the cartridge tray 13 in the state illustrated in FIG. 9 is being pushed into the main body 100. FIGS. 11 and 12 are each a view of a state in which the cartridge tray 13 is pushed in the main body 100. FIG. 11 is a view of a state in which the guided portion 13*a* is located in the positioning portion 14T at the time of insertion of the cartridge tray 13. FIG. 12 is a view of a case where the cartridge tray 13 is in an image formation mode.

In the state illustrated in FIG. 9, the cartridge tray 13 is moved in the main body 100 while the guided portion 13*a* thereof is guided along the first guiding part 14S of the guiding portion 14R, and enters the state illustrated in FIG. 10.

Subsequently, as illustrated in FIG. 11, the guided portion 13*a* comes to the positioning portion 14T. Then, the movement is completed.

After the completion of the movement of the cartridge tray 13, when the opening/closing door 34 is closed, a pressing member (not shown) presses the cartridge tray 13 upward so as to bring the guided portion 13*a* into contact with the positioning portion 14U. With this, the cartridge tray 13 is positioned to the image formation position. At this time, as illustrated in FIG. 12, the drum 1 of each of the process cartridges P positioned in the cartridge tray 13 is brought into contact with the endless belt 6*a*.

(Configuration of Second Guiding Part)

Next, the second guiding part 14V of the guiding portion 14R will be described.

Figure 13:
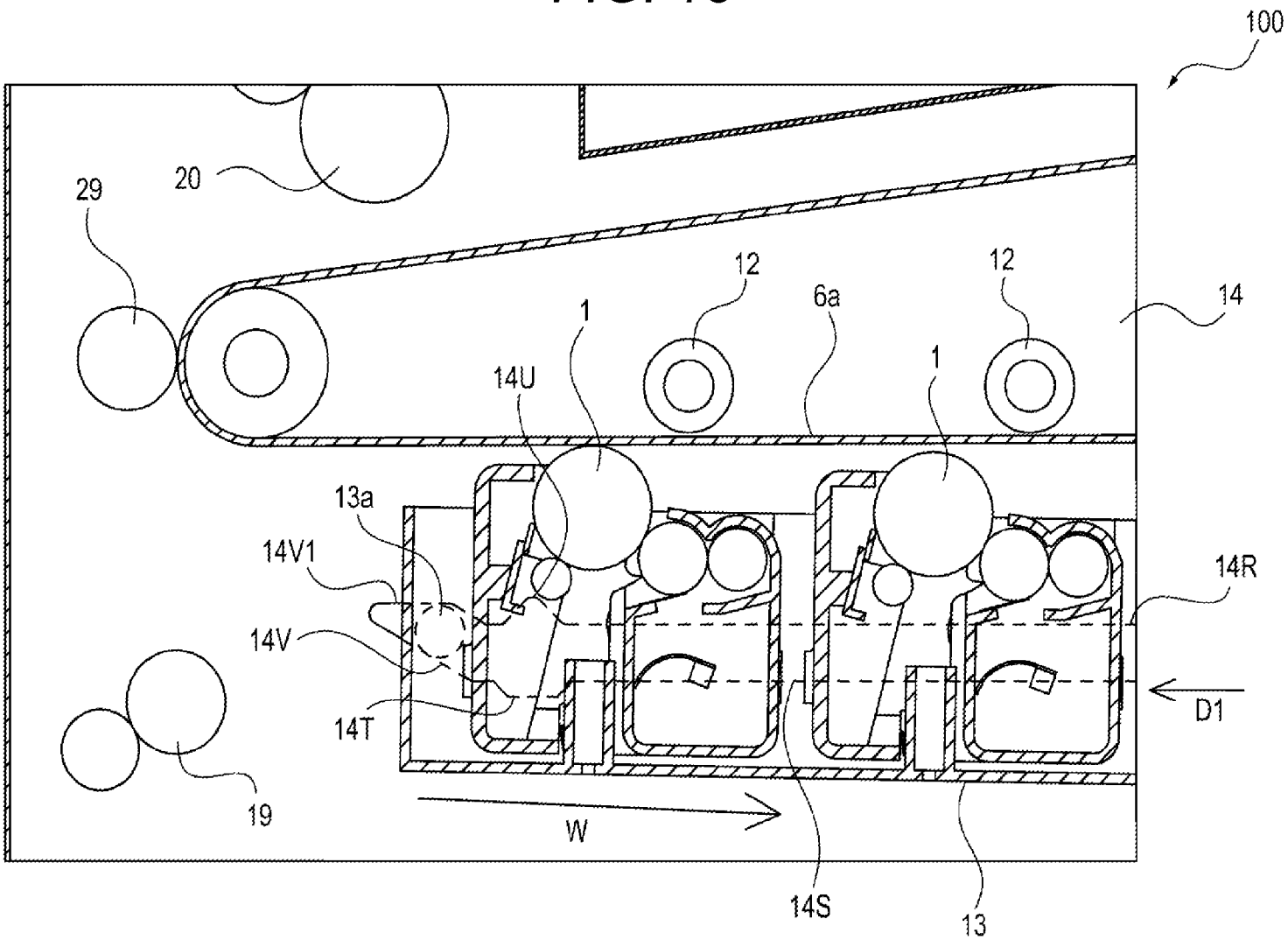
FIG. 13 is a schematic sectional view illustrating movement of the cartridge tray that is forcefully mounted into the main body in the embodiment of the present invention.

FIG. 13 is a schematic sectional view illustrating the movement of the cartridge tray 13 that is forcefully mounted into the main body 100.

As illustrated in FIG. 13, the second guiding part 14V is formed on a downstream side in the inserting direction of the cartridge tray 13 with respect to the positioning portion 14T of the guiding portion 14R. In addition, the second guiding part 14V is extended on the downstream side in the inserting direction with respect to an outermost position G (refer to FIG. 11) of the guided portion 13*a* in a state in which the guided portion 13*a* of the cartridge tray 13 is engaged with the positioning portion 14T. Further, the second guiding part 14V is extended upward in the gravity direction with respect to the first guiding part 14S.

With this configuration, even when the cartridge tray 13 is forcefully mounted in the direction of the arrow D1, a moving speed of the cartridge tray 13 is reduced by its own weight while the cartridge tray 13 is moved in the second guiding part 14V. Specifically, as illustrated in FIG. 13, when the guided portion 13*a* of the forcefully mounted cartridge tray 13 passes over the positioning portion 14T and reaches the second guiding part 14V, the moving speed of the cartridge tray 13 is reduced. Then, the moving direction of the cartridge tray 13 is switched to a direction of the arrow W, and the cartridge tray 13 is stopped when the guided portion 13*a* comes to the positioning portion 14T. In other words, the guided portion 13*a* is lowered along the second guiding part 14V by weights of the cartridge tray 13 and the process cartridges P. In this way, the cartridge tray 13 is moved toward the positioning portion 14T (storage position, inside position).

In other words, the second guiding part 14V has a shape to return the guided portion 13*a* toward the inside position when the cartridge tray 13 has further been moved to the downstream side of the inside position in the inserting direction of the cartridge tray 13.

Furthermore, in the embodiment, there is provided an abutting portion 14V1 (abutting member) configured to abut against the cartridge tray 13 when the guided portion 13*a* enters the second guiding part 14V, to thereby limit the movement of the cartridge tray 13. With this, the forcefully mounted cartridge tray 13 is prevented from running up along the second guiding part 14V so that components stored in the cartridge tray 13, such as the drums 1, can be prevented from interfering with the endless belt 6*a*. In the embodiment, the guided portion 13*a* of the cartridge tray 13 is brought into contact with the abutting portion 14V1 on the downstream side in the inserting direction of the cartridge tray 13 with respect to the positioning portion 14T in the state in which the guided portion 13*a* is positioned at the positioning portion 14T (FIG. 11).

Second Embodiment

Next, an image forming apparatus according to another embodiment of the present invention will be described. Note that, the basic configuration of the second embodiment is the same as that of the first embodiment, and hence only differences from the first embodiment will be described below. Further, the same or similar parts as those in the first embodiment are denoted by the same reference symbols to omit redundant description.

In the first embodiment, the guided portion 13*a* of the forcefully mounted cartridge tray 13 is moved to the positioning portion 14T only by gravity. In the embodiment, in order to more reliably perform the positioning, there is provided a returning mechanism 25 configured to return the guided portion 13*a* to the positioning portion 14T.

Figure 14A:
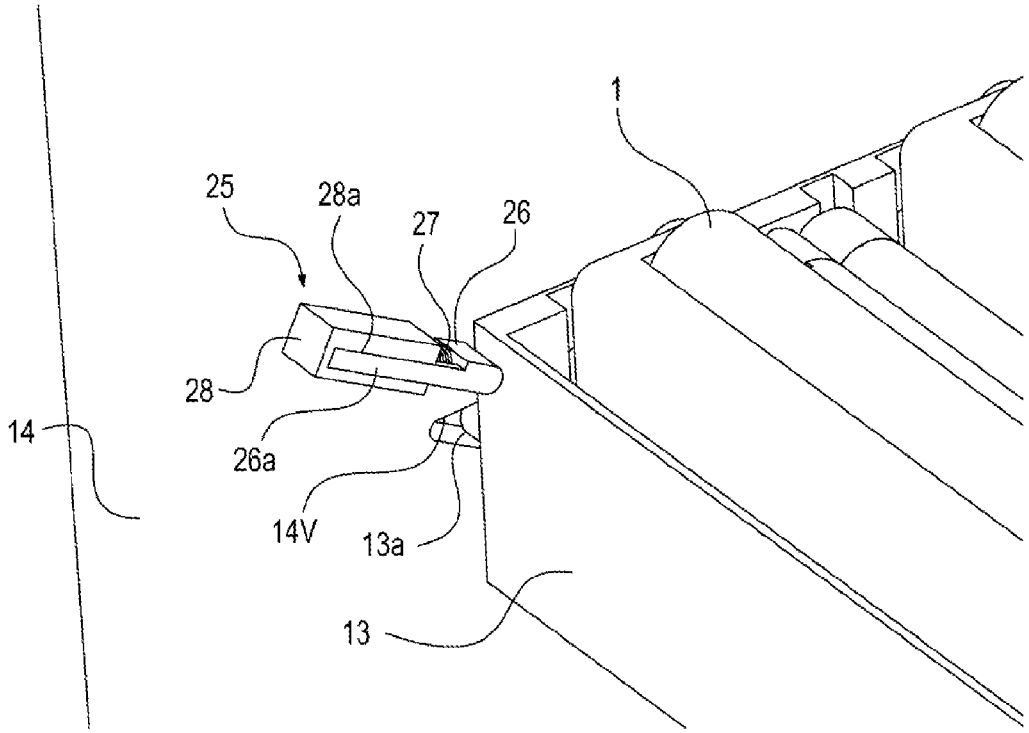
FIG. 14A is a partial perspective view of a state in which the cartridge tray that is forcefully mounted into an image forming apparatus according to another embodiment of the present invention is held in contact with a returning mechanism.
Figure 14B:
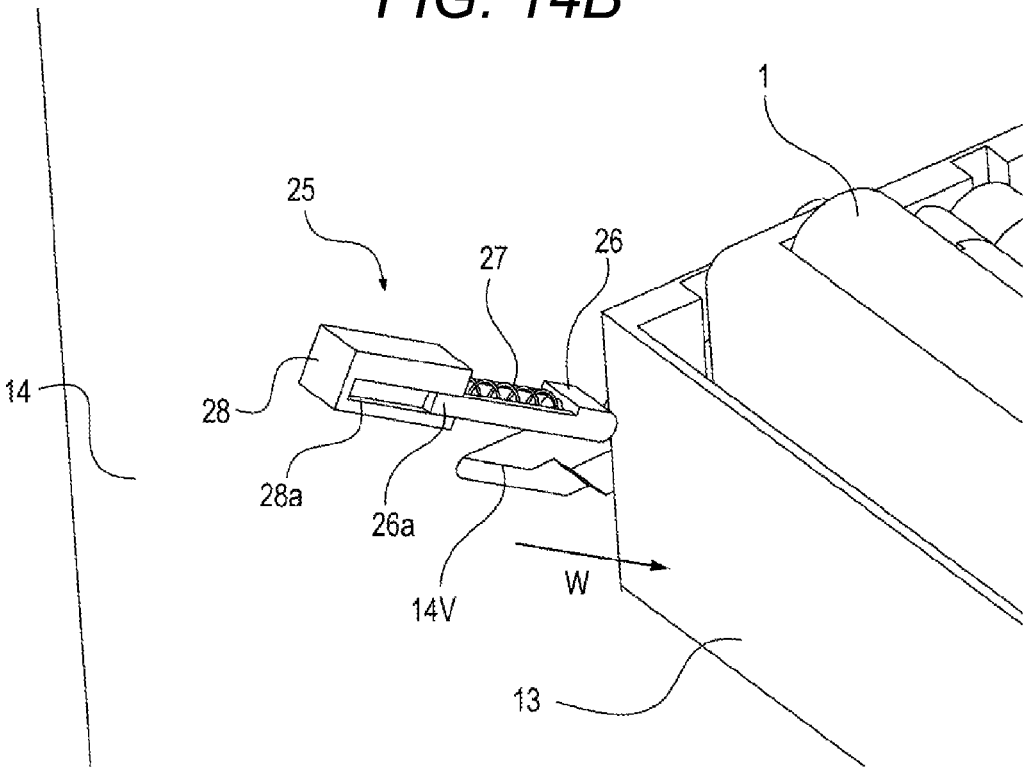
FIG. 14B is a partial perspective view of a state in which the cartridge tray is returned to the positioning portion after the contact with the returning mechanism.

FIGS. 14A and 14B are each a partial perspective view of the image forming apparatus according to the embodiment, which includes the returning mechanism 25. FIG. 14A is a view of a state in which the forcefully mounted cartridge tray 13 is held in contact with the returning mechanism 25, and FIG. 14B is a view of a state in which the cartridge tray 13 is returned to the positioning portion 14T after the contact with the returning mechanism 25.

As illustrated in FIGS. 14A and 14B, the returning mechanism 25 includes a contact member 26 to be brought into contact with the cartridge tray 13, and a support member 28 fixed to the frame 14 and configured to support the contact member 26 in a slidable manner. The contact member 26 includes rib-shaped parts 26*a* so as to be slidable along groove portions 28*a* formed in the support member 28. Further, the returning mechanism 25 also includes a pressing member 27 fixed at one end portion to the contact member 26 and configured to press the contact member 26.

When the guided portion 13*a* of the forcefully mounted cartridge tray 13 is further moved to the downstream side of the positioning portion 14T in the inserting direction of the cartridge tray 13, as illustrated in FIG. 14A, the cartridge tray 13 is brought into contact with the contact member 26. With this, the pressing member 27 is compressed to absorb impact. A restorative force of the compressed pressing member 27 and the own weight of the cartridge tray 13 cause the guided portion 13*a* of the cartridge tray 13 to be moved to the positioning portion 14T (direction of the arrow W in FIG. 14B).

As described in the embodiment, the second guiding part 14V and the returning mechanism 25 are used in combination. With this, the impact to the cartridge tray 13 at the time of the forceful mounting can be reduced, and the guided portion 13*a* of the cartridge tray 13 can be more reliably moved to the positioning portion 14T.

Third Embodiment

Next, an image forming apparatus according to another embodiment of the present invention will be described. Note that, the basic configuration of the third embodiment is the same as that of the first embodiment, and hence only differences from the first embodiment will be described below. Further, the same or similar parts as those in the first embodiment are denoted by the same reference symbols to omit redundant description.

In the embodiment, a returning mechanism 30 (pressing mechanism) configured to interlock with the opening/closing door 34 so as to return the forcefully mounted cartridge tray 13 to a predetermined position is used.

(Configuration of Returning Mechanism)

Figure 15:
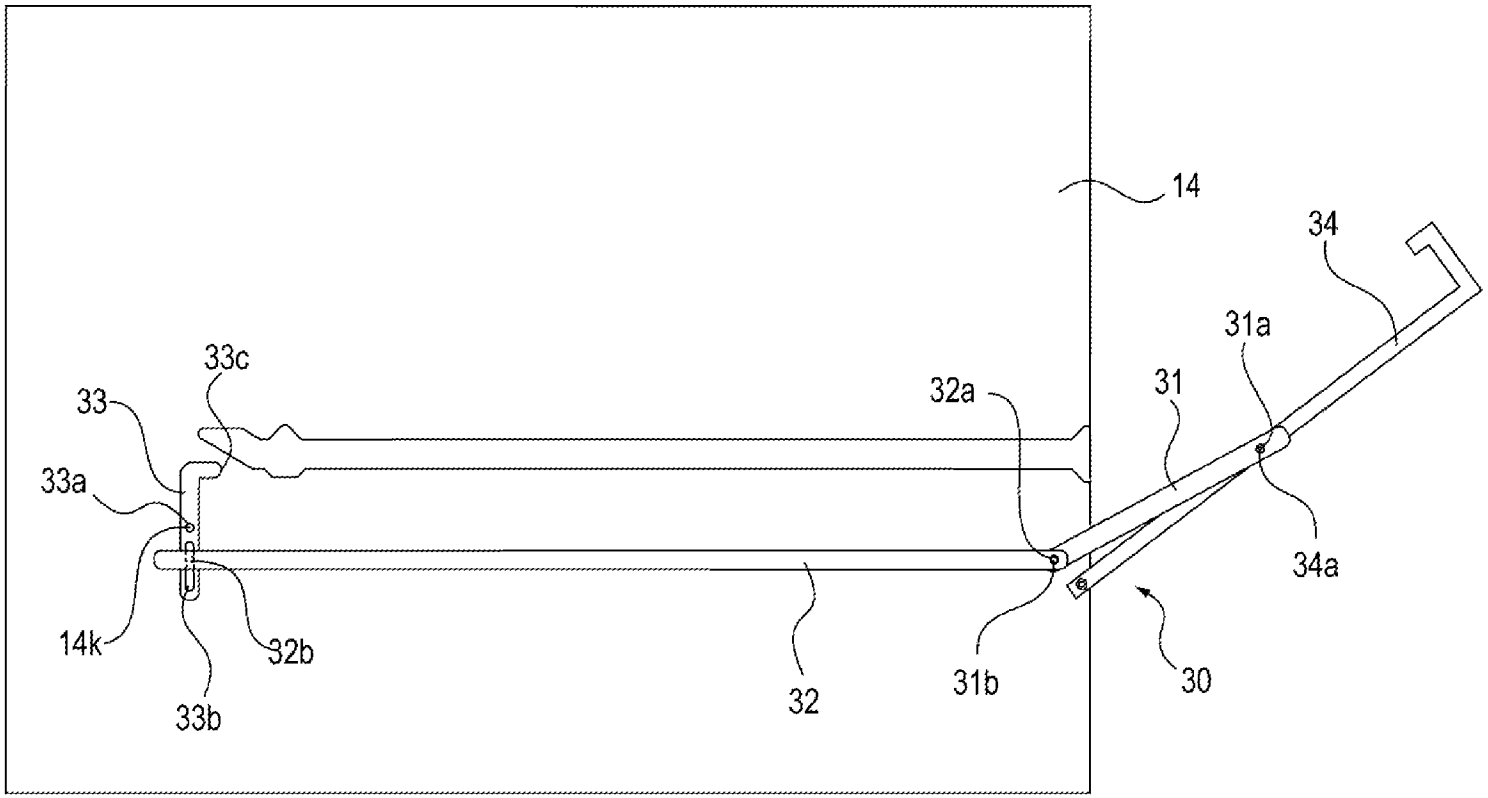
FIG. 15 is a view illustrating a returning mechanism that interlocks with an opening/closing door of an image forming apparatus according to still another embodiment of the present invention.

FIG. 15 is a view of the opening/closing door 34, the frame 14, and the returning mechanism 30, for illustrating the returning mechanism 30 that interlocks with the opening/closing door 34.

As illustrated in FIG. 15, the returning mechanism 30 includes a link member 31, a sliding member 32, and a returning member 33. The link member 31 includes a hole portion 31*a* and a protruding portion 31*b*. The hole portion 31*a* is engaged with a protruding portion 34*a* formed on the opening/closing door 34, and the protruding portion 31*b* of the link member 31 is engaged with a hole portion 32*a* formed through the sliding member 32.

The sliding member 32 is supported to be movable substantially in the horizontal direction with respect to the frame 14, and includes the hole portion 32*a* and a protruding portion 32*b*. The returning member 33 includes a hole portion 33*a*, a cutout portion 33*b*, and a contact portion 33*c*. The hole portion 33*a* of the returning member 33 is supported to be turnable by a protruding portion 14*k* formed on the frame 14. Further, the protruding portion 32*b* of the sliding member 32 is engaged with the cutout portion 33*b* of the returning member 33.

(Movement of Returning Mechanism)

Next, movement of the returning mechanism 30 will be described.

Figure 16A:
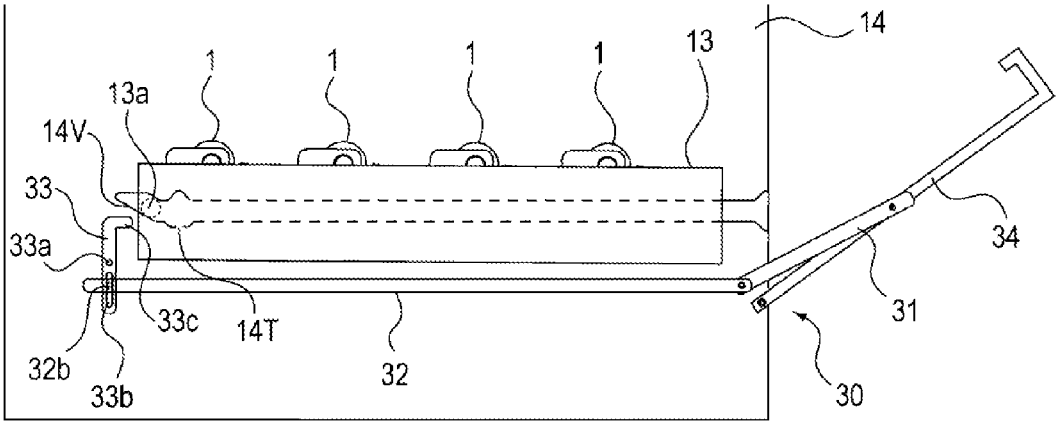
FIGS. 16A, 16B, and 16C are each a partial sectional view illustrating movement of the returning mechanism that interlocks with the opening/closing door in the embodiment illustrated in FIG. 15.
Figure 16B:
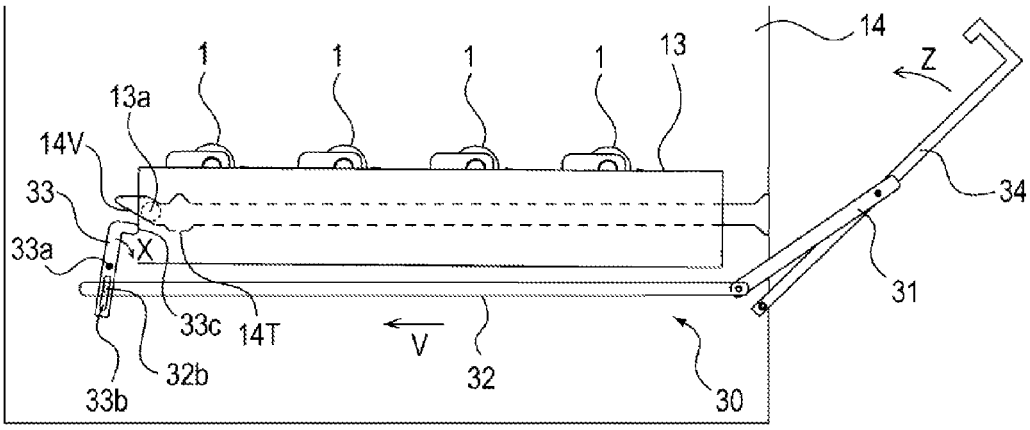
Figure 16C:
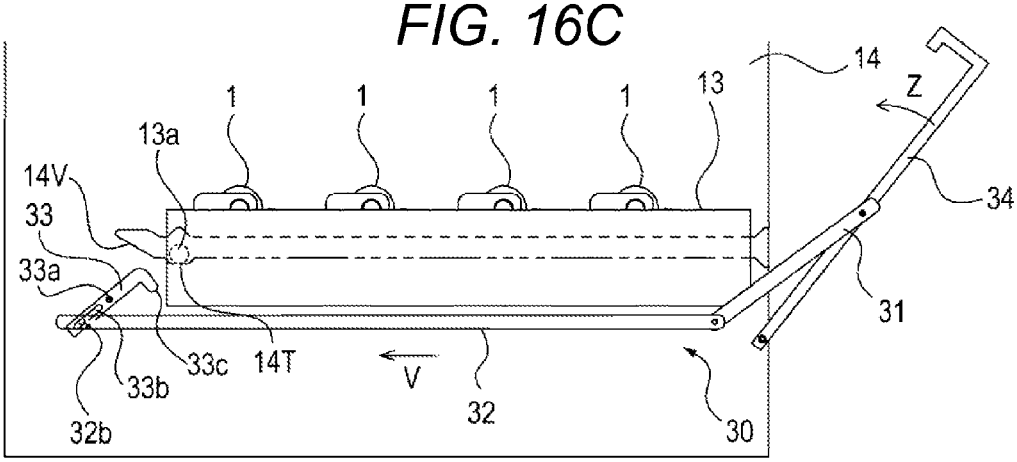

FIGS. 16A, 16B, and 16C are each a partial sectional view illustrating the movement of the returning mechanism 30 that interlocks with the opening/closing door 34. In those drawings, components other than the cartridge tray 13, the opening/closing door 34, the returning mechanism 30, the frame 14, and the process cartridges P are omitted. FIG. 16A is a view of a state in which the guided portion 13*a* of the forcefully mounted cartridge tray 13 is stopped halfway in the second guiding part 14V without returning to the positioning portion 14T. FIG. 16B is a view of a state in which the opening/closing door 34 in the state of FIG. 16A starts to be closed. FIG. 16C is a view of a state in which the opening/closing door 34 in the state of FIG. 16B is further closed.

When the opening/closing door 34 in the state of FIG. 16A is closed in a direction of the arrow Z as illustrated in FIG. 16B, along therewith, the sliding member 32 is moved in a direction of the arrow V, and the returning member 33 is moved in a direction of the arrow X. With this, the contact portion 33*c* of the returning member 33 is brought into contact with the cartridge tray 13. When the opening/closing door 34 is further closed in the direction of the arrow Z, along therewith, as illustrated in FIG. 16C, the guided portion 13*a* starts to be moved toward the positioning portion 14T. Movement of the guided portion 13*a* can be assisted until immediately before the guided portion 13*a* comes to the positioning portion 14T (FIG. 16C).

As described above, when the second guiding part 14V and the returning mechanism 30 are used in combination, the cartridge tray 13 can be more reliably located in the positioning portion 14T in conjunction with the opening/closing door 34.

Note that, in the first to third embodiments described above, the second guiding part 14V is formed of a flat surface extended in a direction opposite to the gravity direction, but the present invention is not limited thereto. For example, there may be employed a curved surface extended in the direction opposite to the gravity direction, or a combination of the curved surface and the flat surface.

Further, advantages of the first to third embodiment described above can be summarized as follows. According to the embodiments described above, in the case where the containing member is mounted into the main body, the guided portion of the containing member is guided along the first guiding part along with the movement of the containing member between the outside position and the inside position. Then, the second guiding part is formed into such a shape that the guided portion is biased to cause the containing member to be returned toward the inside position when the containing member is moved further from the inside position to the downstream side in the inserting direction of the containing member. With this, when the containing member is forcefully mounted, the containing member can be effectively decelerated. As a result, scattering of toner or damage to components can be suppressed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-110961, filed May 29, 2014, which is hereby incorporated by reference herein in its entirety.

What is claimed is:

1. An image forming apparatus in which a cartridge is removably mountable to a main body of the image forming apparatus, the image forming apparatus comprising:

a containing member configured to contain the cartridge and movable between an outside position outside the main body and an inside position inside the main body in a state of containing the cartridge, the containing member being moved from the outside position in an inserting direction so as to be moved to the inside position, the containing member being movable from the inside position in a first direction different from the inserting direction and movable from the inside position in a second direction different from the first direction, the containing member being moved from the inside position in the first direction so as to move the cartridge to an image forming position for an image formation, the containing member being moved from the inside position in the second direction so as to be moved to a downstream side of the inside position in the inserting direction, and the containing member being provided with a guided portion; and a guiding portion provided in the main body and configured to guide a movement of the guided portion, wherein the guiding portion includes:

a first guiding part configured to guide the guided portion while the containing member is moved between the outside position and the inside position in the inserting direction; and a second guiding part which comes into contact with the guided portion when the containing member is moved in the second direction, the second guiding part having a shape to return the containing member toward the inside position when the second guiding part comes into contact with the guided portion.

2. An image forming apparatus according to claim 1, wherein the second guiding part is extended downstream of the first guiding part in the inserting direction of the containing member, and is provided on an upper side of the first guiding part with respect to a gravity direction.

3. An image forming apparatus according to claim 2, wherein the second guiding part is extended downstream of the guided portion in the inserting direction of the containing member when the containing member is located in the inside position.

4. An image forming apparatus according to claim 1, wherein the guiding portion includes a first positioning portion configured to position the containing member when the containing member is located in the inside position.

5. An image forming apparatus according to claim 4, wherein the first positioning portion includes a recessed portion provided on a lower side of the guiding portion with respect to a gravity direction, and wherein a part of the guided portion enters the recessed portion to position the containing member.

6. An image forming apparatus according to claim 1, further comprising a pressing member configured to press the containing member toward the inside position when the containing member is further moved to the downstream side of the inside position in the inserting direction of the containing member.

7. An image forming apparatus according to claim 1, further comprising an abutting member configured to abut against the containing member so as to limit a movement of the containing member when the containing member is further moved to the downstream side of the inside position in the inserting direction of the containing member.

8. An image forming apparatus according to claim 1, wherein the main body includes:

an insertion opening through which the containing member is inserted;

a door configured to close the insertion opening after the containing member is inserted; and a pressing mechanism configured to interlock with an operation of closing the door so that the pressing mechanism presses the containing member toward the inside position when the containing member is further moved to the downstream side of the inside position in the inserting direction of the containing member.

9. An image forming apparatus according to claim 1, further comprising a moving unit configured to move the containing member in the first direction so that the cartridge contained in the containing member comes to the image forming a position at a time of the image formation of the image forming apparatus, wherein the guiding portion includes a positioning portion configured to position the containing member so that the cartridge comes to the image forming position when the containing member is moved by the moving unit.

10. An image forming apparatus according to claim 9, wherein the positioning portion includes a recessed portion provided on an upper side of the guiding portion with respect to a gravity direction, and wherein a part of the guided portion enters the recessed portion to position the containing member.

11. An image forming apparatus according to claim 1, wherein the guided portion is lowered along the second guiding part by weights of the containing member and the cartridge so that the containing member is moved from a position on the downstream side of the inside position toward the inside position.

12. An image forming apparatus according to claim 1, further comprising a belt, wherein the cartridge comprises a photosensitive member, and wherein when the containing member is located at the inside position, the photosensitive member is out of contact with the belt, and when the cartridge is located at the image forming position, the photosensitive member is in contact with the belt.

* * * * *